US008556648B2

(12) United States Patent
Wu

(10) Patent No.: US 8,556,648 B2
(45) Date of Patent: Oct. 15, 2013

(54) CABLE ASSEMBLY WITH AN OUTER COVER HAVING A MOVABLE LID

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/437,861

(22) Filed: Apr. 2, 2012

(65) Prior Publication Data

US 2012/0302077 A1 Nov. 29, 2012

(30) Foreign Application Priority Data

May 23, 2011 (CN) ..... 2011 1 0133733

(51) Int. Cl.
*H01R 13/62* (2006.01)
*H01R 13/52* (2006.01)

(52) U.S. Cl.
USPC ..... 439/367; 439/276

(58) Field of Classification Search
USPC ..... 439/271–276, 367, 587
See application file for complete search history.

(56) References Cited

U.S. PATENT DOCUMENTS

| | | | | |
|---|---|---|---|---|
| 5,791,936 | A * | 8/1998 | Nicholson | 439/521 |
| 6,589,082 | B2 * | 7/2003 | Harasawa et al. | 439/752 |
| 7,048,563 | B2 * | 5/2006 | Fukuda et al. | 439/276 |
| 7,500,866 | B2 * | 3/2009 | Gennai et al. | 439/367 |
| 7,628,638 | B2 | 12/2009 | Wu | |
| 7,993,151 | B2 * | 8/2011 | Chuo et al. | 439/260 |
| 2003/0181100 | A1 * | 9/2003 | Kuroda et al. | 439/582 |
| 2011/0130030 | A1 * | 6/2011 | Morita | 439/499 |

* cited by examiner

*Primary Examiner* — Chandrika Prasad
(74) *Attorney, Agent, or Firm* — Wei Te Chung; Ming Chieh Chang

(57) ABSTRACT

A cable assembly comprises an insulative housing receiving a plurality of mating terminals therein, a cable extending beyond the housing and having a plurality of wires, a plurality of connecting terminals electrically terminated to the wires respectively, and an outer cover enclosing the housing and having a dustproof lid being delectably between an open position while the connecting terminals being exposed to an exterior and a closed position while the connecting terminals being covered by the dustproof lid for dustproof protection. The connecting terminals penetrate into the corresponding wires, respectively.

20 Claims, 10 Drawing Sheets

CABLE ASSEMBLY WITH AN OUTER COVER HAVING A MOVABLE LID

BACKGROUND OF THE INVENTION

1. Field of the Invention

The present invention relates to a cable assembly, and more particularly to a cable assembly with an improved dustproof lid.

2. Description of Related Art

Low profile and multi-functional features have become the main stream for design of the electrical device, and a cable assembly for the electrical device has to be compact, while also capable of performing a high-speed transmission, and reliable connection and easily detachable with its counterpart. Cable assemblies made in accordance with USB, SATA, HDMI, DiiVA and Displayport protocols have been widely applied in different kinds of electronic devices. U.S. Pat. No. 7,628,638B2 issued to Wu on Dec. 8, 2009 discloses a cable assembly. The cable assembly includes an insulative housing, a plurality of terminals, a terminal organizer attached to a rear end of housing, a cable having a plurality of wires corresponding to the terminals, and a metal shell enclosing the housing. Each of the terminals has a body portion, a curved mating portion extending forwardly from the body portion, and a tail portion extending rearwardly from the body portion. The terminal organizer includes a base portion and a tongue portion forwardly extending from the base portion. An upper portion and a lower portion of the tongue portion define a plurality of terminal slots aligned in a row by side-to-side manner, and the base portions also define a plurality of through holes and each through hole aligns with corresponding terminal slot.

When assembling the cable assembly, firstly, the terminals are arranged on the terminals organizer, with the mating portions extending beyond the terminal organizer, the body portions are then securely located in the terminal slots of the tongue portion, the termination portions via the through holes and disposed on an upper and a bottom surfaces of the base portion. Secondly, the terminals and the terminal organizer together are assembled to the housing. Thirdly, the wires of the cable are respectively soldered to the tail portions of the terminals. Fourthly, the metal shell is assembled to the housing. However, the wires may be broken away from the tail portions or the terminal organizer may become loose with respect to the housing while the metal shell is assembling to the housing and the cable assembly are in transportation etc. Thus, This would be result in bad contact between the wires and the terminals.

Hence, an improved cable assembly is highly desired to overcome the above problems.

BRIEF SUMMARY OF THE INVENTION

According to one aspect of the present invention, a cable assembly comprising: an insulative housing receiving a plurality of mating terminals therein; a cable extending beyond the housing and having a plurality of wires; a plurality of connecting terminals electrically terminated to the wires, respectively; and an outer cover enclosing the housing and having a dustproof lid being delectably disposed between an open position while the connecting terminals being exposed to an exterior and a closed position while the connecting terminals being covered by the dustproof lid for dustproof protection.

According to another aspect of the present invention, a cable assembly comprises: an insulative housing defining a cavity for receiving a corresponding connector; a sub PCB received in the housing; a plurality of mating terminals received in the housing, each of the mating terminals having a mating portion exposed to the cavity and a tail portion soldered on the sub PCB; a plurality of connecting terminals, each including a first contact portion, and a second contact connected with the sub PCB; an outer cover enclosing the housing and the sub PCB, the outer cover has dustproof lid covering the connecting terminals for dustproof protection, and a compartment receiving the dustproof lid; and a cable having a plurality of wires electrically connected with the sub PCB via the connecting terminals; wherein the first contact portions downwardly pierce into corresponding wires respectively by an outer force and presses onto the connecting terminals while the dustproof lid is at an open position.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
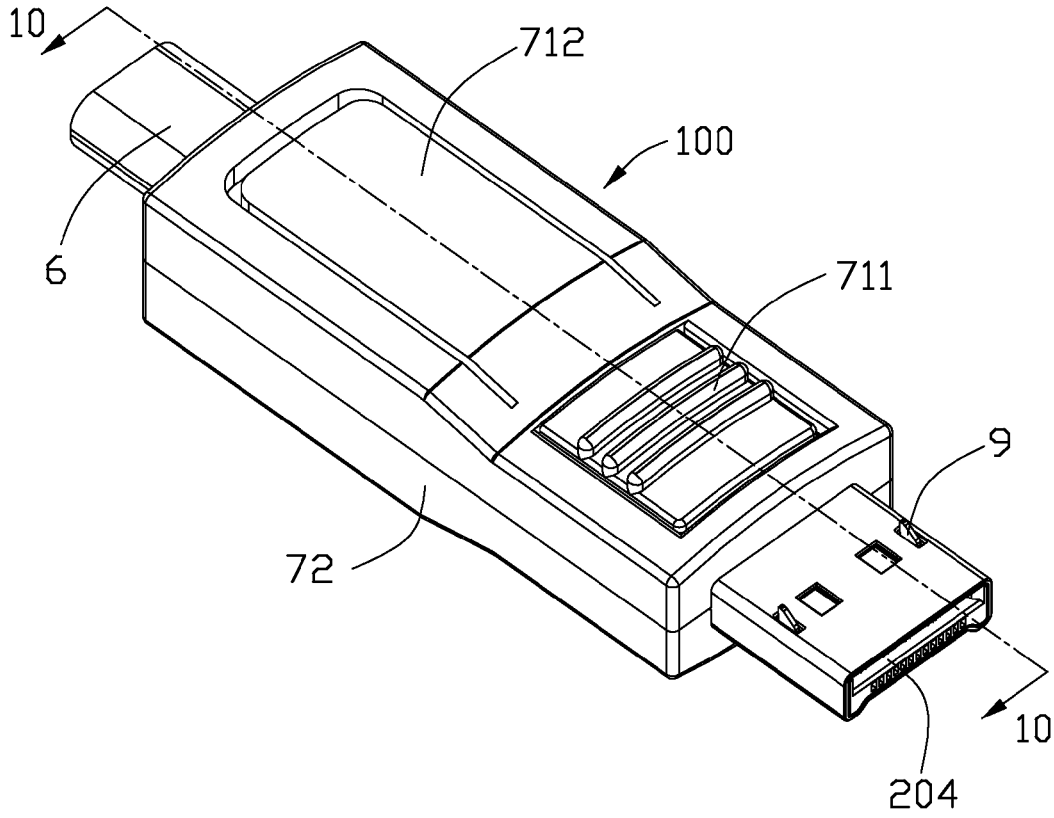
FIG. 1 is an assembled, perspective view of a cable assembly according to an embodiment of the present invention.
Figure 2:
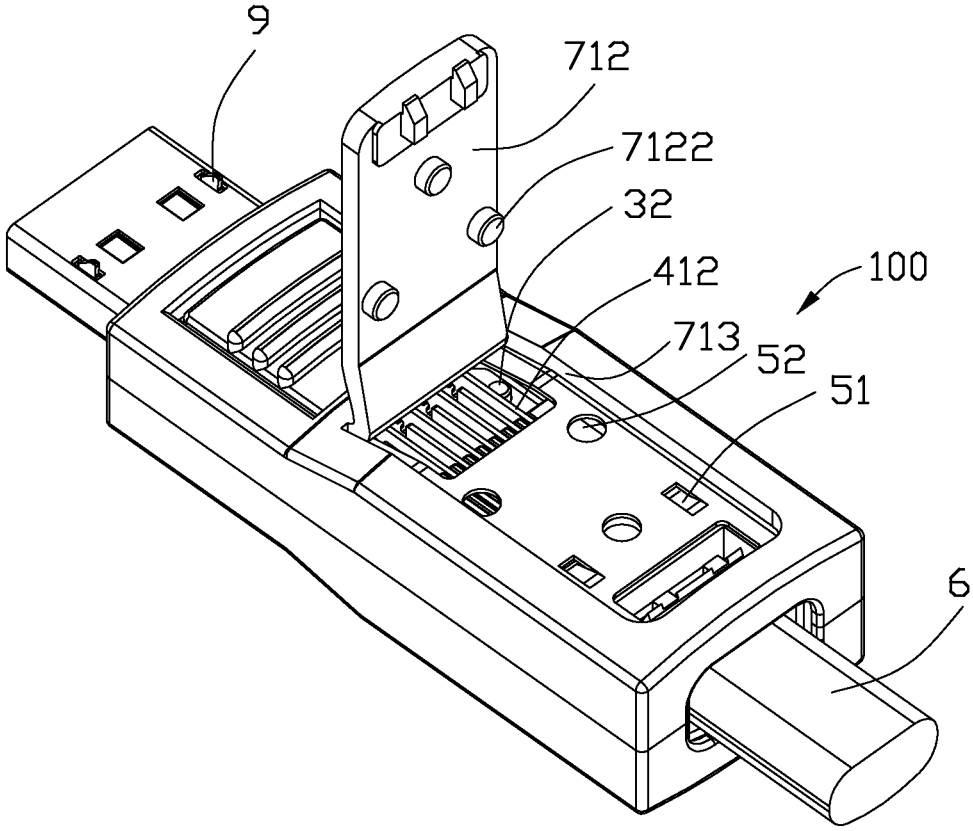
FIG. 2 is another assembled, perspective view of the cable assembly with a dustproof lid being opened.
Figure 3:
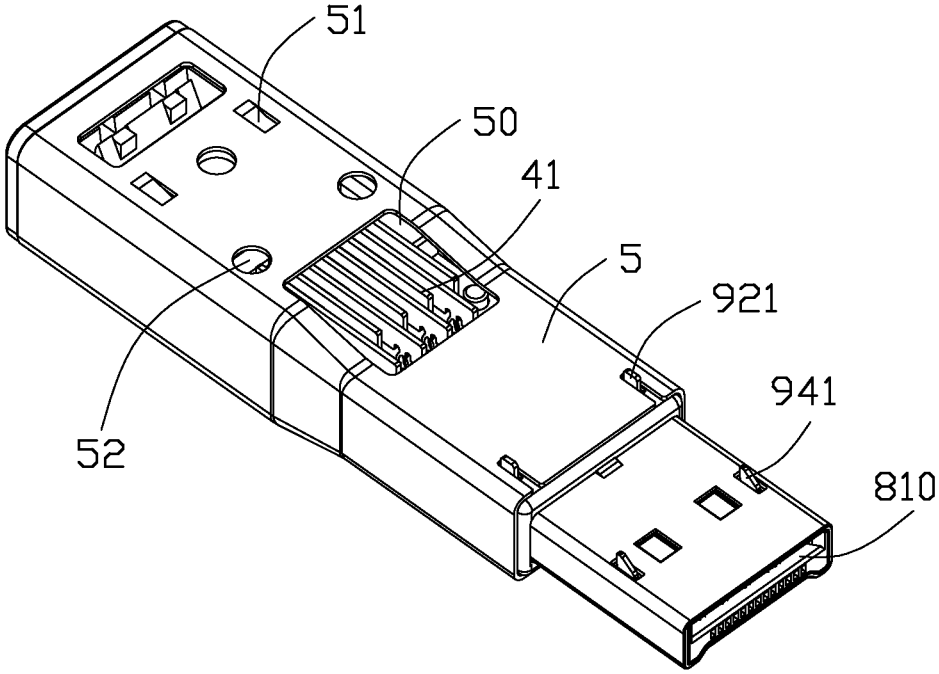
FIG. 3 is a third assembled, perspective view of the cable assembly without an outer cover thereof.
Figure 4:
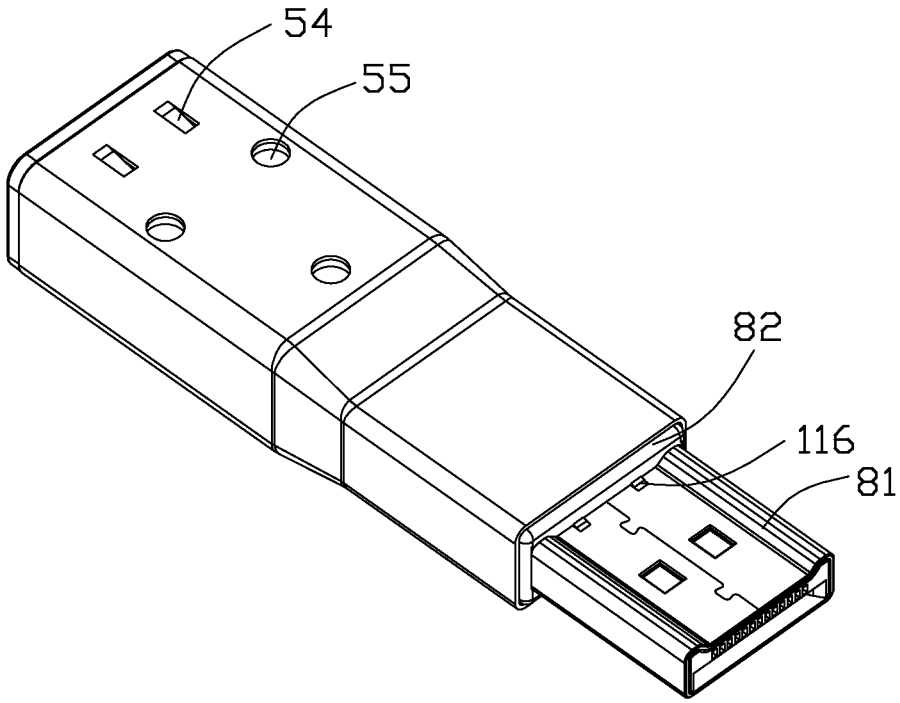
FIG. 4 is similar to FIG. 3, but viewed from another aspect.
Figure 5:
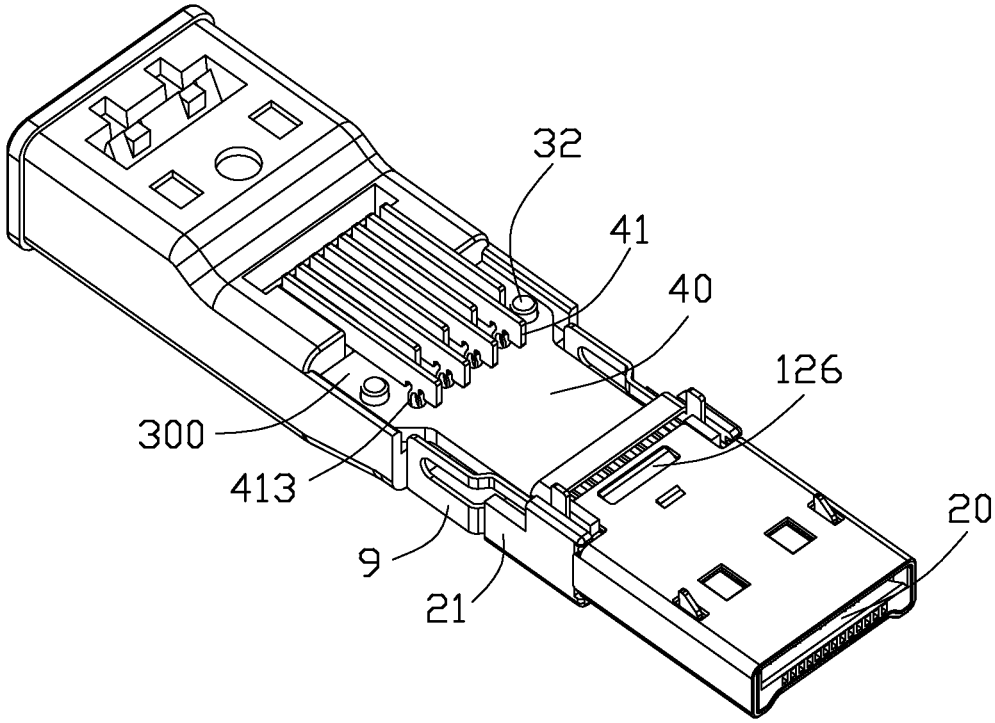
FIG. 5 is a fourth assembled, perspective view of the cable assembly without an outer cover and an outer shell thereof.
Figure 6:
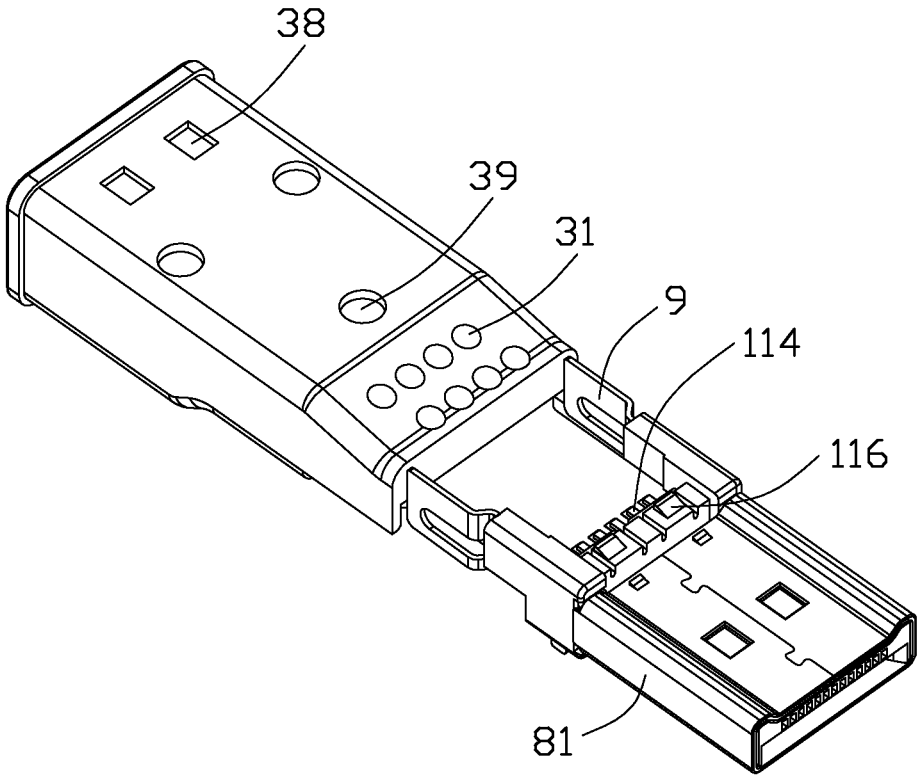
FIG. 6 is similar to FIG. 4, but viewed from another aspect.

In the following description, numerous specific details are set forth to provide a thorough understanding of the present invention. However, it will be obvious to those skilled in the art that the present invention may be practiced without such specific details.

Referring to FIGS. 1-10, a cable assembly 100 according to an embodiment of the present invention comprises a terminal module 1, an insulative housing 2 receiving the terminal module 1 therein, an insulative spacer 3 disposed behind the housing 2, a metal outer shell 5 covering the spacer 3, a cable 6 backwardly extending beyond the spacer 3, an insulative outer cover 7 covering the outer shell 5, and a metal inner shell 8 covering the housing 2, and a metallic latch 9 retained in the housing 2. The cable assembly 100 further includes a sub PCB 40 soldered with the terminal module 1, a plurality of connecting terminals 41 respectively connecting between corresponding wires 62 of the cable 6.

Figure 7:
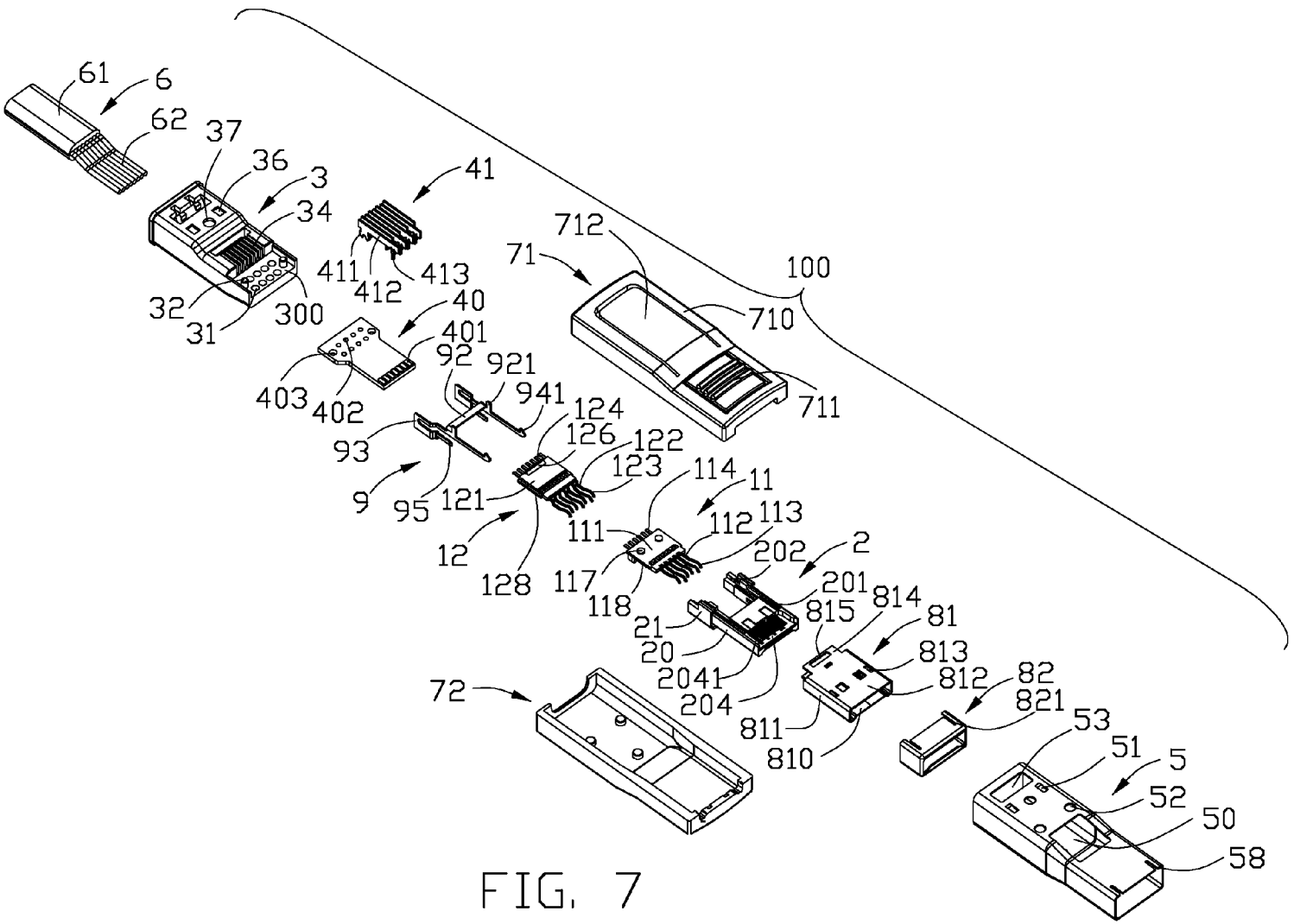
FIG. 7 is an exploded view of the cable assembly.
Figure 8:
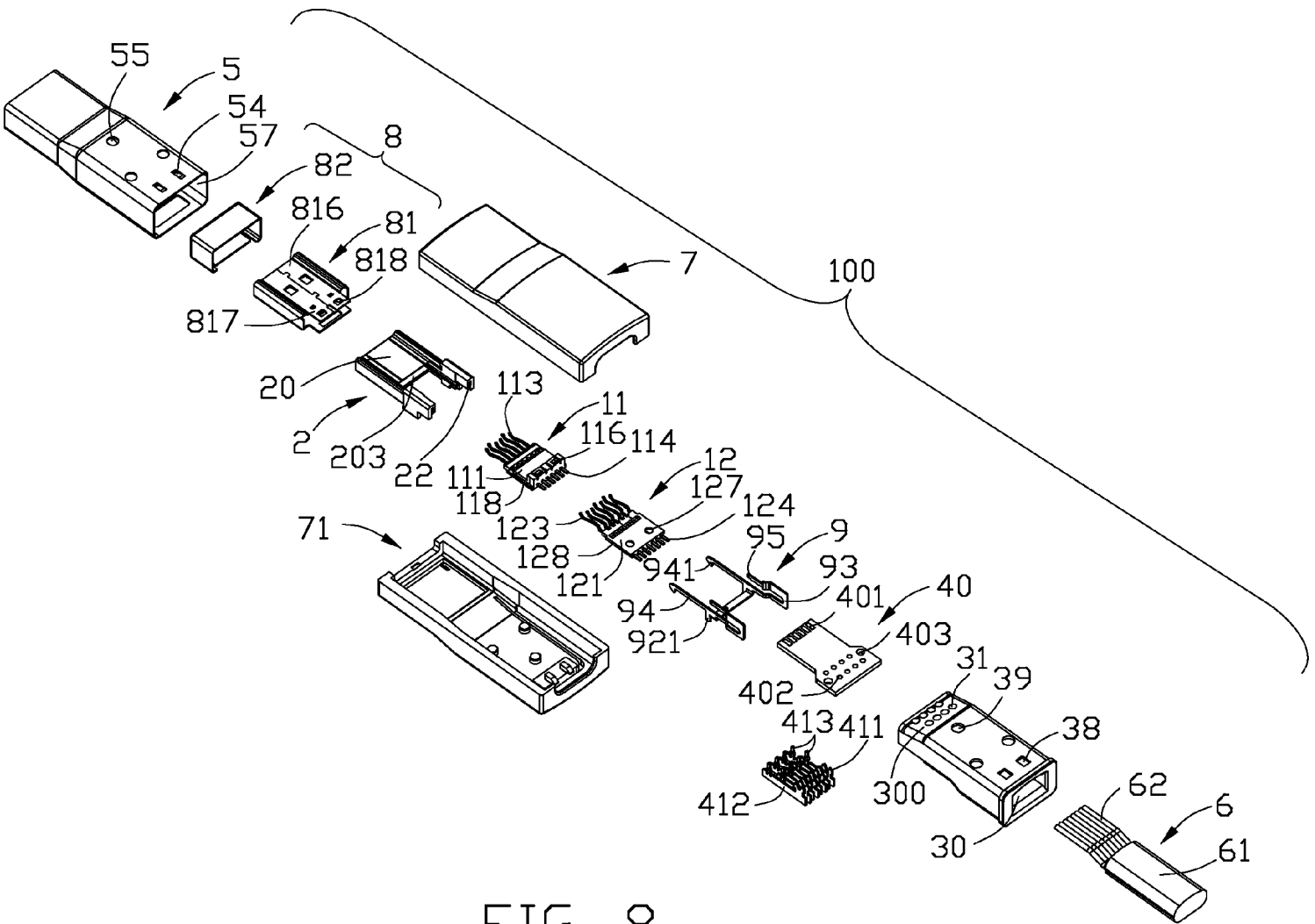
FIG. 8 is similar to FIG. 7, but viewed from another aspect.
Figure 9:
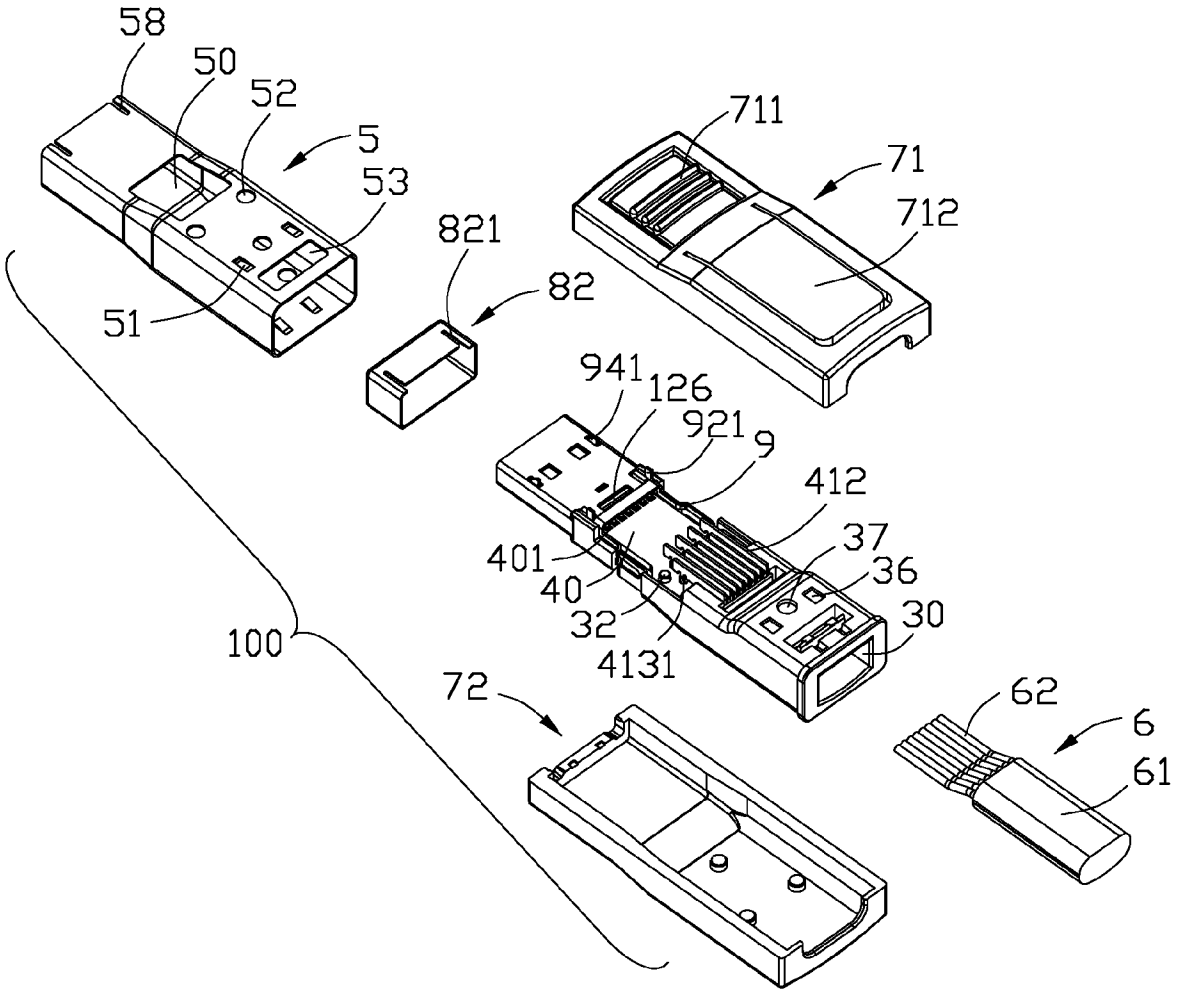
FIG. 9 is a partially exploded view of the cable assembly.
Figure 10:
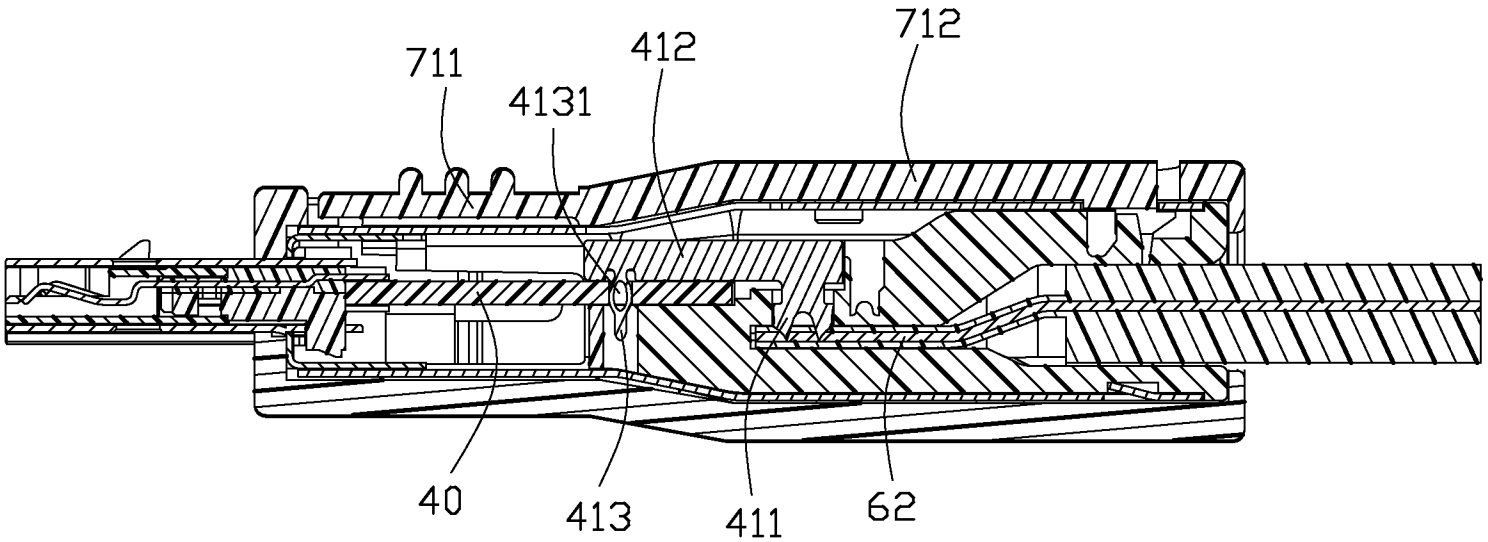
FIG. 10 is a cross-section view along 10-10 line of FIG. 1.

Referring to FIGS. 7-8, the housing 2 includes a main portion 20, and a pair of mounting arms 21 extending rearwardly from two lateral sides of the main portion 20. The mounting arms 21 each defines a mounting hole 22 forwardly recessed from a rear end thereof. The main portion 20 defines a pair of longitudinal slots 201 recessed from a top of two lateral sides thereof and backwardly extending into the mounting arms 21. Each of the pair of mounting arms 22 has a sliding slot 202 formed on inner side surface thereof. The main portion 20 defines a receiving space 203 recessed forwardly from a middle segment of a rear edge thereof, and a cavity 204 is recessed downwardly from a top side thereof and passing through a front end thereof. A set of passageways 2041 are recessed downwardly from a bottom wall of the cavity 204.

The spacer 3 includes a front end defining a positioning hole 30 retaining the cable 6, and a rear end opposited to the front end and defining a main plate 300 extending forwardly. The main plate 300 has a plurality of receiving slots 34 forwardly extending from the positioning hole 30, two rows of through holes 31 disposed at front of the receiving slots 34 and two positioning posts 32 located at two lateral sides of the through holes 31 for securing the sub PCB 40. The positioning hole 30 is surrounded around by a top wall, a bottom wall, and a pair of side walls. The top wall defines a pair of first locking slots 36 opposited to each other in a left-to-right direction, and a circle hole 37 disposed between the pair of locking slots 36. The bottom wall defines a pair of second locking slots 38 opposited to each other in the left-to-right direction, and three circle holes 39 disposed at front of the locking slots 38.

The terminal module 1 includes a first terminal module 11 and a second terminal module 12 assembled to each other in an upper-to-lower direction. The first terminal module 11 has a first insulator 111 and a plurality of first mating terminals 112 combined together by insert-molding process. The first mating terminals 112 are divided into signal terminals and grounding terminals configured to be longer than the signal terminals. The first mating terminals 112 have first mating portions 113 forwardly extending beyond the first insulator 111, and first tail portions 114 backwardly extending beyond the first insulator 111. A pair of retaining tabs 116 are formed in a bottom side of the first insulator 111 and a pair of protruding portions 117 are formed in a top side of the first insulator 111. The first insulator 111 further has a pair of first protruding edges 118 respectively protruding laterally from two lateral sides thereof and positioned in the guiding slots 202 of the housing 2.

The second terminal module 12 has a second insulator 121 and a plurality of second mating terminals 122 combined together by insert-molding process. The second mating terminals 122 are divided into signal terminals and grounding terminals configured to be longer than the signal terminals. The first and second mating terminals 112, 122 are combined together to adapt for the DiiVA protocol. The second mating terminals 122 have second mating portions 123 forwardly extending beyond the second insulator 121 and second tail portions 124 backwardly extending from the second insulator 121. The second insulator 121 has a retaining block 126 formed in a top side thereof, a pair of mounting holes 127 retaining the pair of protruding portions 117 of the first insulator 111 therein, and a pair of pair of second protruding edges 128 respectively protruding laterally from two lateral sides thereof and positioned in the guiding slots 202 of the housing 2.

The sub PCB 40 has a front end sandwiched between the mounting arms 21 of the housing 2, and a rear end downwardly supported onto the main plate 300 of the spacer 3. The front end has a plurality of conductive pads 401 soldered with the tail portions 114, 124 of the terminal module 2. The rear end has two rows of locating holes 402 aligned with the through holes 31 of the spacer 3 in the upper-to-lower direction, and a pair of securing holes 403 retaining with the positioning posts 32 of the spacer 3.

The connecting terminals 41 each includes a vertical body portion 412 retained in the corresponding receiving slot 34 of the spacer 3, a first contact portion 411 downwardly protruding from a rear end thereof, and a second contact portion 413 downwardly protruding from a front end thereof to be inserted into the corresponding locating hole 402 of the sub PCB 40. The first contact portions 411 are disposed toward the positioning hole 30 and partly received in the receiving slots 34 respectively. The second contact portions 413 downwardly protruding through the locating holes 402 and are partly receiving in the through holes 31 respectively. Each of the first contact portions 411 is coattail shaped with two taper/sharp ends. Each of the second contact portions 413 is press-fit type and has a slit 4131 formed therethrough.

The metallic latch 9 includes a pair of latching plates 91 spaced apart from each other along the left-to-right direction, and a connecting bridge 92 therebetween. Each latching plate 91 includes an U-shaped connecting portion 93, a latching arm 94, a retention portion 95, a hook 941 disposed at a front end of the latching arm 94, and a pressing tab 921 protruding upwardly from a top side of the latching arm 92. The pressing tab 921 is behind the hook 941 and adjacent to the connecting bridge 94. The retention portions 95 are inserted into the mounting holes 22 of the corresponding mounting arms 21 of the housing 2, and the latching arms 94 are received in the slots 201 of the housing 2.

The inner shell 8 includes a first inner shell 81 and a second inner shell 82 surrounding around the first inner shell 81. The first inner shell 81 includes a frame 811 defining a room to accommodate the base portion 20 of the housing 2 therein to form a mating plug. Two through holes 813 are defined in a front segment of a top side of the frame 811 to allow hooks 941 passing through. A first engaging portion 814 projects backwardly from the top side. An engaging hole 815 is defined in the first engaging portion 814 to latch with the protruding portion 126 of the second insulator 121. The frame 811 also has a bottom side with a second engaging portion 814 projecting backwardly therefrom. Two engaging holes 818 are defined in the second engaging portion 814 to latch with the protruding tabs 116 of the first insulator 111. The second inner shell 82 is rectangular hollow structure and has two slits 821 to allow the pressing tab 921 to upwardly pass through.

The outer shell 5 is hollow structure and has a receiving space 57 receiving the housing 2 and the spacer 3 therein. A front portion of the outer shell 5 has a pair of cuts 58 at a top side thereof and the corresponding slits 821 of the second inner shell 82 for the pressing tabs 921 passing through. The top side defines a first opening 50 communicating with the receiving space 57 to make the body portions 412 of the connecting terminals 41 to be disposed to exterior, a pair of first circle holes 52 disposed behind the first opening 50, a pair of protruding plates 51 downwardly protruding into the receiving space 57, and a second opening 53 disposed at a rear portion thereof. A top side of the outer shell 5 defines three second circle holes 55 and a pair of protruding plates 54 upwardly protruding into the receiving space 57. The first circle holes 52 of the outer shell 5 are respectively aligned with the circle hole 37 of the spacer 3 in the upper-to-lower direction. The protruding plates 51 are respectively locked into the first locking slots 36 of the spacer 3 to assemble the outer shell 5 and the spacer 3 with each other. The second circle holes 55 are respectively aligned with the circle holes 39 of the spacer 3 in the upper-to-lower direction. The protruding plates 54 of the outer shell 5 are respectively locked into the second locking slots 38.

The cable 6 includes a jacket 61, a number of wires 62 enclosed in the jacket 61 and passing through the positioning hole 30 of the spacer 3 into the receiving slots 34. Each of the wires 62 has an insulative layer and a conductor enclosed in the layer. The first contact portions 411 of the connecting terminals 41 respectively penetrate into the corresponding wires 62 to allow the connecting terminals 41 to electrically connect with the conductors of the wires 62.

The outer cover 7 includes an upper cover 71 and a lower cover 72 combined together in the upper-to-lower direction and surrounding the metallic outer shell 5. The upper cover 71 has a top wall 710 defining a deformable button 77 floatable along the upper-to-lower direction to drive the pressing tabs 921 upwardly or downwardly so as to actuate the hooks 941 protruding out off or into the frame 811 of the inner shell 8, a flexible dustproof lid 712, and a compartment 713 accommodating the dustproof lid 712 therein. The compartment 713 passes through the top wall 710 in the upper-to-lower direction. The dustproof lid 712 is rectangle shaped viewed in the upper-to-lower direction and includes a front end integrated with an inner side of the compartment 713, a rear end opposited to the front end, and a pair of lateral sides. The front end and the pair of lateral sides are respectively disconnect from inner sides of the compartment 713 to allow the dustproof lid 712 to rotate by the front end in the upper-to-lower direction.

When assembling the cable assembling 100, firstly, the first terminal module 11 and the second terminal module 12 are stacked with each other in the upper-to-lower direction. The pair of protruding portions 117 of the first terminal module 11 are respectively retained in the mounting holes 127 of the second terminal module 12. The first and the second terminal modules 11, 12 together are assembled in the receiving space 203 of the housing 2. The first and the second mating portions 113, 123 are received in the passageways 2041 and exposed to the cavity 204 for mating with a corresponding connector (not shown), and the first and the second tail portions 114, 124 are soldered with the conductive pads 401 of sub PCB 40.

Secondly, the metallic latch 9 is forwardly retained in the housing 2, the lathing arms 94 are received in the slots 201 of the mounting arms 21, the hooks 941 and the pressing tabs 921 upwardly protrude beyond the housing 2, and the retention portions 95 are forwardly inserted into the mounting holes 22 of the mounting arms 21.

Thirdly, the first inner shell 81 backwardly encloses the housing 2 to allow the hooks 941 to pass through the through holes 813 of the first inner shell 81.

Fourthly, the sub PCB 40 is retained onto the main plate 300 of the spacer 3 via the positioning posts 32 of the main plate 300 are respectively inserted into the securing holes 403 of the sub PCB 40, the locating holes 402 of the sub PCB 40 are aligned with the through holes 31 of the spacer 3 in the upper-to-lower direction.

Fifthly, the cable 6 is retained in the positioning hole 30 of the spacer 3, the wires 62 are respectively received in the receiving slots 34.

Sixthly, the connecting terminals 41 are respectively received in the receiving slots 34 of the spacer 3, the first contact portions 411 downwardly press onto the insulative layers of the wires 62 of the cable 6, and the second contact portions 413 are respectively partly inserted into the locating holes 402 of the sub PCB 40.

Seventhly, the second inner shell 82 backwardly covers the first inner shell 81 and the pressing tabs 921 of the metallic latch 9 upwardly pass through the slits 821 of the second inner shell 82.

Eighthly, the outer shell 5 covers the housing 2 and the spacer 3, the protruding plates 51 downwardly lock into the first locking slots 36 of the spacer 3, the protruding plates 54 upwardly lock into the second locking slots 38 of the spacer 3. The pressing tabs 921 upwardly pass through the cuts 58 of the outer shell 5.

Finally, the outer cover 7 encloses the outer shell 5, the deformable button 77 is floatable along the upper-to-lower direction to drive the pressing tabs 921 upwardly or downwardly so as to actuate the hooks 941 to protrude out off or into the inner shell 8, the dustproof lid 712 covers the body portions 412 of the connecting terminals 41 for dustproof protection, and the dustproof lid 712 has a plurality of protrusions 7122 respectively downwardly inserted into the first circle holes 52 of the outer shell 5 for retaining the dustproof lid 712. Conjunction with FIG. 10, the connecting terminals 4 are exposed to exterior when the dustproof lid 712 is opened, then an instrument (not shown) could be inserted into the compartment 713 of the upper cover 71 and the first opening 50 of the inner shell 5, and push the body portion 412 of connecting terminals 41 to urge the first contact portions 411 to penetrate into the corresponding wires 62 to allow the connecting terminals 41 to electrically connect with the conductors of the wires 62, and the second contact portions 413 continue to downwardly move to be fully inserted into the locating holes 402 of the sub PCB 40. Thus, the cable 6 would be electrically connected with the sub PCB 40 reliably by the connecting terminals 41. Assemblers could watch connection status among the connecting terminals 41, the wires 62 and the sub PCB 40 when the dustproof lid 712 is opened.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable assembly comprising:

an insulative housing receiving a plurality of mating terminals therein;

a cable extending beyond the housing and having a plurality of wires;

a plurality of connecting terminals electrically terminated to the wires, respectively; and an outer cover enclosing the housing and having a dustproof lid being deflectably disposed between an open position while the connecting terminals being exposed to an exterior and a closed position while the connecting terminals being covered by the dustproof lid for dustproof protection.

2. The cable assembly according to claim 1, wherein the dustproof lid is flexibly interleafed with a top wall of the outer cover and is pivotable between the opening position and the closed position.

3. The cable assembly according to claim 1, wherein the outer cover includes a top wall defining a compartment to accommodate the dustproof lid, the dustproof lid includes a front end integrated with an inner side of the compartment, a rear end opposited to the front end, and a pair of lateral sides, the front end and the pair of lateral sides all of which are respectively disconnect from inner sides of the compartment to allow the dustproof lid to be rotatable with regarding the front end in the upper-to-lower direction as a shaft.

4. The cable assembly according to claim 1, further comprising a spacer received in the outer cover, the spacer includes a positioning hole retaining the cable therein, and a main plate defining a plurality of receiving slots extending forwardly from the positioning hole, each of the wires and the corresponding connecting terminal are received in a same receiving slot.

5. The cable assembly according to claim 4, wherein each of the connecting terminals includes a vertical body portion received in the corresponding receiving slot, and a first contact portion downwardly protruding from a rear end of the body portion and penetrating into the corresponding wire.

6. The cable assembly according to claim 5, further includes a sub PCB retained on the main plate, the sub PCB has a plurality of conductive pads disposed on a front end thereof to be soldered with the mating terminals, and a plurality of locating holes form on a rear end thereof, each of the connecting terminals has a second contact portion protruding downwardly from a front end of the body portion and inserted into the locating hole of the sub PCB to allow the sub PCB to be connected between the wires and the mating terminals.

7. The cable assembly according to claim 6, further comprising a metallic outer shell enclosing the housing, the spacer and the sub PCB are accommodated in the outer cover, the inner shell forms an opening opposited to dustproof lid so as to allow an instrument to be inserted to press onto the body portions of the connecting terminals while the dustproof lid is at the open position.

8. The cable assembly according to claim 4, further comprising a metallic shell accommodated in the outer cover and enclosing both of the housing and the spacer, the shell defines a plurality of through holes, the dustproof lid has a plurality of protrusions downwardly inserted into the through holes of the shell for retaining the dustproof lid in the closed position.

9. A cable assembly comprising:

an insulative housing defining a cavity for receiving a corresponding connector;

a sub PCB received in the housing;

a plurality of mating terminals received in the housing, each of the mating terminals having a mating portion exposed to the cavity and a tail portion soldered on the sub PCB;

a plurality of connecting terminals, each including a first contact portion, and a second contact connected with the sub PCB;

an outer cover enclosing the housing and the sub PCB, the outer cover has dustproof lid covering the connecting terminals for dustproof protection, and a compartment receiving the dustproof lid; and a cable having a plurality of wires electrically connected with the sub PCB via the connecting terminals;

wherein the first contact portions downwardly pierce into corresponding wires respectively by an outer force and presses onto the connecting terminals while the dustproof lid is at an open position.

10. The cable assembly according to claim 9, wherein the dustproof lid is integrated with the outer cover and is pivotable.

11. The cable assembly according to claim 9, wherein the dustproof lid includes a front end integrated with an inner side of the compartment, a rear end opposited to the front end, and a pair of lateral sides, the front end and the pair of lateral sides are respectively disconnect from inner sides of the compartment to allow the dustproof lid to be rotatable, considering the front end in the upper-to-lower direction as a shaft.

12. The cable assembly according to claim 9, further comprising a metallic shell enclosing the housing and having an opening, so that the connecting terminals are exposed to an exterior while the dustproof lid is at the open position, the shell further defines at least one through hole adjacent to the opening, the dustproof lid has at least one protrusion engaging with the through hole for preventing the dustproof lid from moving a closed position to the open position.

13. An electrical cable connector assembly comprising:

an insulative housing defining a mating port;

a plurality of terminals assembled to the housing with, in a front-to-back direction, front contacting sections exposed in the mating port and rear tail portions mounted to a printed circuit board behind the housing;

a plurality of wires extending rearward behind the printed circuit board;

a plurality of connecting terminals located between the plurality of wires and the printed circuit board in said front-to-back direction under condition that the connecting terminals are assembled to both said printed circuit board and the corresponding wires in a vertical direction perpendicular to said front-to-back direction; and an outer cover enclosing front portions of the wires, the connecting terminals, the printed circuit board, and a rear portion of the housing;

wherein said outer cover is equipped with a moveable dustcover to cover said connecting terminals.

14. The electrical cable connector assembly as claimed in claim 13, further including a metallic outer shell intimately enclosed in the outer cover wherein said outer cover is insulative.

15. The electrical cable connector assembly as claimed in claim 14, further including an insulative spacer enclosed in the metallic outer shell, wherein a rear portion of the printed circuit board is supportably disposed and the connecting terminals are loaded.

16. The electrical cable connector assembly as claimed in claim 14, wherein the outer shell defines an opening through which the connecting terminals can be viewed when the moveable dustcover is opened.

17. The electrical cable connector assembly as claimed in claim 13, wherein the dustcover is moveable in generally a rotational manner.

18. The electrical cable connector assembly as claimed in claim 13, wherein a deformable button in front of and opposite to the moveable dustcover for actuating a pair of hooks formed on a pair of pressing tabs.

19. The electrical cable connector assembly as claimed in claim 13, wherein each of said connecting terminals includes a press-fit front tail for engagement within a corresponding through hole in the printed circuit board, and an IDC (Insulative Displacement Contact) rear tail for engagement within the corresponding wire under condition that both said press-fit front tail and said IDC rear tail extend in the vertical direction.

20. The electrical cable connector assembly as claimed in claim 13, further including a first inner metallic shell enclosing a front portion of the housing and a second inner metallic shell enclosing a rear portion of the housing.

* * * * *